United States Patent [19]

Rath et al.

[11] 4,075,441

[45] Feb. 21, 1978

[54] SLIDE SWITCH HAVING RESILIENT MOVABLE CONTACT ARM TWISTED TO PROVIDE EFFICIENT ELECTRICAL CONNECTION

[75] Inventors: Wilhelmus Johannes Franciscus Rath; Johannes Martinus Augustinus Henricus van der Donk, both of Eindhoven, Netherlands

[73] Assignee: U.S. Philips Corporation, New York, N.Y.

[21] Appl. No.: 657,559

[22] Filed: Feb. 12, 1976

[30] Foreign Application Priority Data

Apr. 7, 1975 Netherlands ..... 7504084

[51] Int. Cl.[2] ..... H01H 15/06; H01H 1/50

[52] U.S. Cl. ..... 200/16 D; 200/257; 200/258; 200/275

[58] Field of Search ..... 200/11 G, 11 K, 11 TW, 200/16 D, 153 K, 252, 253, 257, 258, 260, 275, 282, 283, 273

[56] References Cited

U.S. PATENT DOCUMENTS

| | | | |
|---|---|---|---|
| 3,196,223 | 7/1965 | Hartsock et al. | 200/16 D |
| 3,222,465 | 12/1965 | Huntress et al. | 200/11 TW |
| 3,222,467 | 12/1965 | Meyer | 200/16 D |
| 3,566,049 | 2/1971 | Wright | 200/11 TW X |
| 3,567,891 | 3/1971 | Hinklemann | 200/16 D X |
| 3,594,527 | 7/1971 | Brant et al. | 200/257 X |
| 3,643,046 | 2/1972 | Zdanys, Jr. et al. | 200/16 D X |
| 3,857,008 | 12/1974 | van der Donk | 200/275 X |
| 3,906,429 | 9/1975 | Rhodes | 200/11 G X |

*Primary Examiner*—James R. Scott

*Attorney, Agent, or Firm*—Frank R. Trifari; Rolf E. Schneider

[57] ABSTRACT

A slide switch having S-shaped movable contact springs which are movably connected to the contact slide, the free legs of the contact springs being provided with contact areas twisted through an angle of at least 1°, so that the switch is substantially crackle-free.

3 Claims, 5 Drawing Figures

SLIDE SWITCH HAVING RESILIENT MOVABLE CONTACT ARM TWISTED TO PROVIDE EFFICIENT ELECTRICAL CONNECTION

BACKGROUND OF THE INVENTION

1. Field of the Invention

This invention relates to a slide switch comprising a strip-like contact slide provided with movable contact springs and slidable in its longitudinal direction between two walls of an electrically insulating housing extending parallel to the plane of the contact slide and provided with fixed contacts. Each of the contact springs is formed from one piece of plate-like material and consists of a central portion and two contact portions which are approximately L-shaped, the end of one leg thereof being connected to the central portion, while the end of the other leg is free and comprises a contact area which co-operates with the fixed contacts, the arrangement being such that the contact spring is approximately S-shaped.

2. Description of the Prior Art

A switch of this type is known from U.S. Pat. No. 3,857,008 issued to one of the co-inventors in the instant application. In this switch the central portion of the movable contact has an opening through which a pin formed on the contact slide projects for the purpose of connecting the contact spring. One of the advantages of such a slide switch is that the contact spring has very good resiliency even though it is very small. However, it has been found in practice that on occasion the electrical contact between the movable and the fixed contacts is not always properly defined when the slide switch is operated; this becomes manifest in the form of disturbing crackle phenomena.

SUMMARY OF THE INVENTION

The object of the invention is to provide a slide switch which is less susceptible to noisiness such as crackle phenomena.

According to the invention the contact spring is movable with respect to the contact slide without it being possible for the spring to become disengaged from the contact slide, while the leg of each contact portion provided with a contact area is twisted through an angle which amounts to at least 1° when the contact spring is not loaded.

The invention will be described in detail hereinafter with reference to the drawing.

DESCRIPTION OF THE PREFERRED EMBODIMENTS

Figure 1:
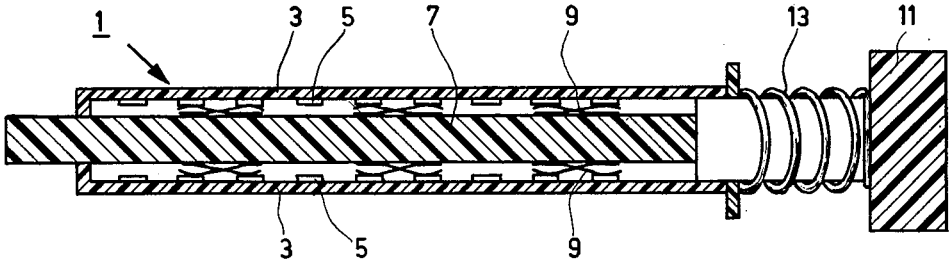
FIG. 1 is a plan view, partly in section, of the interior of a slide switch according to the invention.

The slide switch shown in FIG. 1 comprises a housing 1 having two parallel walls 3 with fixed contacts 5. An elongated contact slide 7, comprising movable contact springs 9, is arranged parallel to the walls and is slidable in its longitudinal direction. The switch can be operated by displacing the contact slide 7 to the left by means of pushbutton 11. A reset spring 13 ensures that the switch returns to the position shown when the pushbutton 11 is released. If desired, the switch can be provided with a known locking mechanism (not shown) which temporarily retains the contact slide in the extreme left position.

Figure 2:
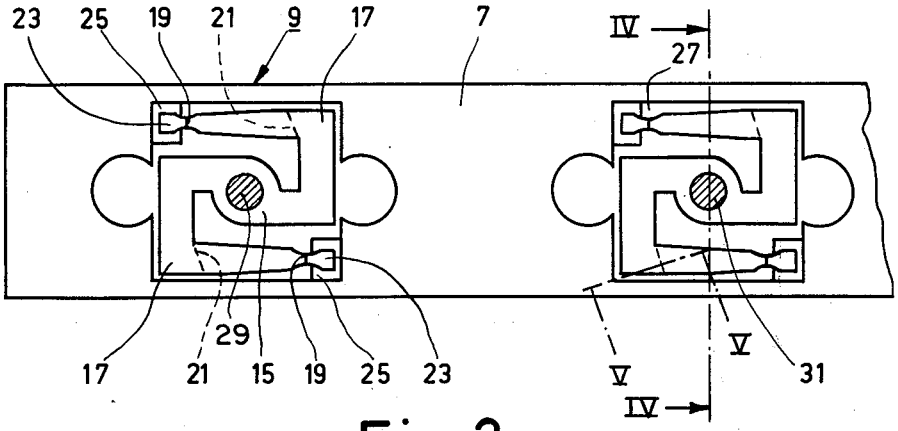
FIG. 2 is a side elevation on an enlarged scale of a portion of the contact slide of the slide switch shown in FIG. 1, certain parts being shown in section.

FIG. 2 shows two of the contact springs 9 at an enlarged scale. Each of the contact springs 9 has a central portion 15 and two approximately L-shaped contact portions 17 which are connected to the central portion by way of the end of one leg, the other leg being elongated, while the end of the other leg is free and comprises a contact area 19. As appears from FIG. 2, the contact spring 9 is approximately S-shaped.

Each contact spring 9 is punched from one piece of strip or plate material in known manner. Subsequently, the legs of the contact portions 17 comprising the contact areas 19 are folded upwards out of the plane of the drawing along bend or folding lines 21, with the result that, when the contact slide is situated inside the housing 1, the legs are spring biased against the fixed contacts 5 (see also FIG. 1). The free ends 23 of the contact portions 17 are bent towards the contact slide 7, so that the contact areas 19 are shaped as a folding line which extends approximately perpendicular to the longitudinal direction of the contact slide. In order to ensure that the ends 23 which are bent back do not impede the spring action, openings 25 are provided in the contact slide 7 at the areas of these ends. If no further steps were taken, the point where the folding line constituting the contact area 19 touches a fixed contact 5 could be situated in an arbitrary position on this folding line. In the case of displacement of the contact spring with respect to the housing, this contact point could readily be shifted to a different position on the folding line. This shifting of the contact point may be a cause of crackle. In order to eliminate this possibility, the legs comprising contact areas 19 are twisted, so that the folding line which constitutes the contact area encloses an angle with the plane of the fixed contacts 5. This can, of course, be realized by regularly twisting the leg over its entire length. In the example shown, however, this object is very simply achieved by making the folding line 21 enclose an angle other than 90° with the longitudinal direction of the leg. The torsion is thus localized in the folding line 21.

Figure 3:
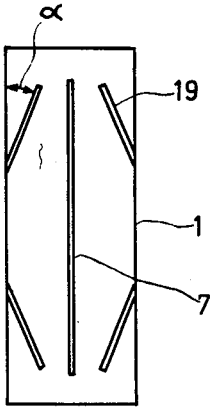
FIG. 3 is a diagrammatic representation of the position of the contact areas of the slide switch shown in FIG. 1, with the contact area and the angle $\alpha$ exaggerated to demonstrate the principle depicted.

FIG. 3 illustrates the relative positions of the housing 1, the contact slide 7 and the contact areas 19 with respect to each other. FIG. 3 is only a very simple diagrammatic representation, in which the angle $\alpha$ is exaggerated for the sake of clarity. So as to ensure that the desired effect is achieved, it is desirable for the torsion angle $\alpha$ not to be smaller than 1°, and not to exceed 10°. A value of approximately 5° was found to be optimum. These values of $\alpha$ are applicable to a non-loaded contact spring, i.e. to the situation in which the contact slide is situated outside the housing. In the loaded condition, the value of $\alpha$ may deviate slightly.

Figure 4:
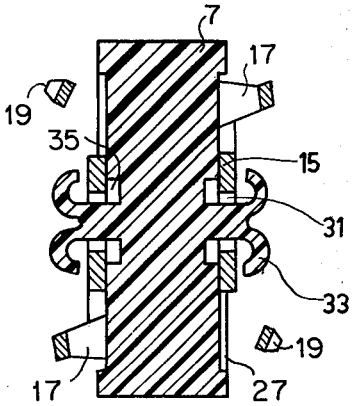
FIG. 4 is an enlarged sectional view taken along the line IV—IV in FIG. 2.
Figure 5:
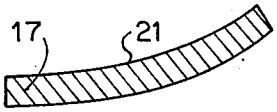
FIG. 5 is a cross-sectional view on an enlarged scale of a portion of a contact taken along the line V—V through the bend line as shown in FIG. 2.

In order to achieve a properly-defined and low-crackle electrical contact, it is also important that the two contact areas 19 press against the relevant fixed contacts 5 with approximately the same force. It was found that this can best be achieved by movably connecting the contact spring 9 to the contact slide 7. When the contact slide 7 is introduced into the housing 1, each contact spring 9 then assumes a position in which the contact pressure is the same for both contact areas 19. On the other hand, for ease of assembly of the switch it is desirable that the contact springs 9 cannot become disengaged from the contact slide 7. These requirements can be satisfied by using a connection arrangement which is shown in detail on an enlarged scale in the sectional view of FIG. 4. The contact spring is situated in a shallow chamber 27 recessed in the contact slide, the chamber accommodating a central pin 29 which projects through a central opening 31 in the central portion 15. On the end of the pin 9 a head 33 is formed by deformation, the diameter of the said head being larger than the diameter of the opening 31, with the result that the contact spring cannot slide off the pin. The diameter of the pin 29 is smaller than that of the central opening 31 and the length of the pin as far as the head 33 is larger than the thickness of the central portion 15 such that the contact spring has ample freedom of movement. Furthermore, an annular chamber 35 is preferably recessed about the base of the pin 29. This is because the punching of the opening 31 may cause a burr which, if it were to touch the bottom of the chamber 27, could limit the freedom of movement of the contact spring 9. The chamber 35 ensures that any burrs cannot touch the bottom of the chamber 27.

It has been found that the combination of a contact spring which is movable with respect to the contact slide and twisted legs comprising contact areas results in a substantially crackle-free slide switch.

What is claimed is:

1. A slide switch comprising a strip-like contact slide having opposite parallel surfaces, each such surface being provided with at least one movable contact spring, a housing having opposing walls parallel to the plane of the contact slide, said contact slide being longitudinally slidable between said opposing housing walls, stationary contacts on each such housing wall for cooperation with the movable contact springs on the opposing contact-slide surface, each movable contact spring including a pair of elongated resilient legs respectively situated on both sides of a planar central portion serving for the connection of said movable contact spring to the contact slide, said pair of legs being formed as an integral unit from a plate-like material with said central portion, each leg being provided with a contact area adjacent its free end, and each leg being folded outwardly with respect to said central portion along a fold line oblique to the longitudinal direction of said leg so as to twist said leg at an angle with respect to said central portion, and means to movably connect each movable contact spring to the contact slide.

2. A slide switch according to claim 1, in which the angle of twist is between approximately 1° and approximately 10° when the movable contact spring is unloaded.

3. A slide switch according to claim 2, in which the angle of twist is approximately 5° when the movable contact spring is unloaded.

* * * * *

UNITED STATES PATENT AND TRADEMARK OFFICE

CERTIFICATE OF CORRECTION

PATENT NO. : 4075441

DATED : February 21, 1978

INVENTOR(S) : Wilhelmus Johannes Franciscus Rath et al

It is certified that error appears in the above-identified patent and that said Letters Patent are hereby corrected as shown below:

Title should read:

--SLIDE SWITCH HAVING RESILIENT MOVABLE CONTACT WITH CONTACT ARM TWISTED TO PROVIDE EFFICIENT ELECTRICAL CONNECTION--

Column 2, line 61, "So as to" should be --To--

Signed and Sealed this

*Thirteenth* Day of *June 1978*

[SEAL]

*Attest:*

RUTH C. MASON
*Attesting Officer*

DONALD W. BANNER
*Commissioner of Patents and Trademarks*